US011849899B2

(12) United States Patent
Lugert et al.

(10) Patent No.: US 11,849,899 B2
(45) Date of Patent: Dec. 26, 2023

(54) DOMESTIC DISHWASHER

(71) Applicant: BSH Hausgeräte GmbH, Munich (DE)

(72) Inventors: Michael Lugert, Jettingen-Scheppach (DE); Bernd Eisenbart, Holzheim (DE); Werner Oblinger, Mödingen (DE)

(73) Assignee: BSH Hausgeräte GmbH, Munich (DE)

( * ) Notice: Subject to any disclaimer, the term of this patent is extended or adjusted under 35 U.S.C. 154(b) by 245 days.

(21) Appl. No.: 17/413,021

(22) PCT Filed: Dec. 12, 2019

(86) PCT No.: PCT/EP2019/084934
§ 371 (c)(1),
(2) Date: Jun. 11, 2021

(87) PCT Pub. No.: WO2020/126838
PCT Pub. Date: Jun. 25, 2020

(65) Prior Publication Data

US 2022/0061625 A1 Mar. 3, 2022

(30) Foreign Application Priority Data

Dec. 21, 2018 (DE) ..... 10 2018 222 849.3

(51) Int. Cl.
*A47L 5/22* (2006.01)
*A47L 15/42* (2006.01)
(Continued)

(52) U.S. Cl.
CPC ..... *A47L 15/428* (2013.01); *A47L 15/22* (2013.01); *A47L 15/4278* (2013.01); *A47L 15/508* (2013.01)

(58) Field of Classification Search
None
See application file for complete search history.

(56) References Cited

U.S. PATENT DOCUMENTS 8,939,162 B2 1/2015 Winkler
10,939,797 B2 3/2021 Buesing
(Continued)

FOREIGN PATENT DOCUMENTS

DE 1628813 A1 7/1970
EP 0988824 A1 3/2000
(Continued)

OTHER PUBLICATIONS

National Search Report DE 10 2018 222 849.3 dated Aug. 6, 2019.
International Search Report PCT/EP2019/084934 dated Apr. 21, 2020.

*Primary Examiner* — Levon J Shahinian
(74) *Attorney, Agent, or Firm* — Michael E. Tschupp; Andre Pallapies; Brandon G. Braun

(57) ABSTRACT

A household dishwasher includes a dishwasher cavity and a spray facility arranged within the dishwasher cavity for spraying washing liquor and/or fresh water in the dishwasher cavity. The spray facility includes a nozzle for spraying the washing liquor and/or the fresh water and a spiral-shaped flow-conducting element for feeding the washing liquor and/or the fresh water to the nozzle. The spiral-shaped flow-conducting element is configured, during operation of the spray facility, to feed the washing liquor and/or the fresh water to the nozzle in such a way that the washing liquor and/or the fresh water exits the nozzle as a rotating conical spray jet.

10 Claims, 10 Drawing Sheets

(51) Int. Cl.
*A47L 15/50* (2006.01)
*A47L 15/22* (2006.01)

(56) References Cited

U.S. PATENT DOCUMENTS

| | | | |
|---|---|---|---|
| 2004/0074527 | A1 | 4/2004 | Yasuo |
| 2010/0116301 | A1 | 5/2010 | Heisele |

FOREIGN PATENT DOCUMENTS

| | | | |
|---|---|---|---|
| EP | 1549196 | A1 | 7/2005 |
| JP | 2005076912 | A | 3/2005 |
| WO | 2014198565 | A1 | 12/2014 |

DOMESTIC DISHWASHER

CROSS-REFERENCES TO RELATED APPLICATIONS

This application is the U.S. National Stage of International Application No. PCT/EP2019/084934, filed Dec. 12, 2019, which designated the United States and has been published as International Publication No. WO 2020/126838 A1 and which claims the priority of German Patent Application, Serial No. 10 2018 222 849.3, filed Dec. 21, 2018, pursuant to 35 U.S.C. 119(a)-(d).

BACKGROUND OF THE INVENTION

The present invention relates to a household dishwasher.

A dishwasher can have a dishwasher cavity and spray facilities arranged in the dishwasher cavity, such as a ceiling-mounted spinning head or rotatably mounted spray arms for example, for spraying items to be washed with washing liquor and/or fresh water.

EP 3 254 600 A1 shows a dishwasher with a dishwasher cavity and a spray arm rotatably mounted on a dishwasher cavity of the dishwasher. The spray arm comprises a large number of spray nozzles, to which washing liquor is fed with the aid of flow-conducting elements.

EP 2 397 060 A2 describes a dishwasher with a spray facility, comprising a deflector which is configured to deflect washing liquor conducted thereto in order to generate a variable spray pattern.

BRIEF SUMMARY OF THE INVENTION

Against this background, one object of the invention consists in providing an improved household dishwasher.

Accordingly, a household dishwasher is proposed. The household dishwasher comprises a dishwasher cavity and at least one spray facility arranged within the dishwasher cavity for spraying washing liquor and/or fresh water in the dishwasher cavity, wherein the spray facility comprises a nozzle for spraying the washing liquor and/or the fresh water and a spiral-shaped flow-conducting element for feeding the washing liquor and/or the fresh water to the nozzle. In this context, the spiral-shaped flow-conducting element is configured, during operation of the spray facility, to feed the washing liquor and/or the fresh water to the nozzle in such a way that the washing liquor and/or the fresh water exits the nozzle as a rotating conical spray jet.

As a result of the washing liquor and/or the fresh water exiting the nozzle as a rotating conical spray jet, items to be washed located in the dishwasher cavity can be made wet by the washing liquor and/or the fresh water in a particularly effective manner, as a chaotic spray pattern can be generated. This improves the cleaning performance of the household dishwasher.

The spray facility can be fastened, for example, at a fixed location on the dishwasher cavity, on a spray arm rotatably mounted in the dishwasher cavity or on a receptacle for items to be washed accommodated in the dishwasher cavity. In particular, the spray facility can also be provided at a bottom or a ceiling of the dishwasher cavity. Preferably, a large number of spray facilities are provided. In the present case, a "conical spray jet" is to be understood to mean a spray jet that has a cone-shaped peripheral surface. The conical spray jet exits the nozzle in a defined exit angle. In the present context, the conical spray jet "rotating" is to be understood in particular to mean that the conical spray jet rotates about an axis of rotation or rotary axis when exiting the nozzle.

In accordance with one embodiment, the spiral-shaped flow-conducting element is embodied in the form of an Archimedean spiral or in the form of a logarithmic spiral.

Depending on the choice of exit rotation direction of the washing liquor and/or the fresh water from the nozzle, it is possible to choose both a left-handed and a right-handed spiral geometry. In the present context, "left-handed" is to be understood in particular to mean a direction of rotation of the spiral-shaped flow-conducting element with a counterclockwise orientation. In the present context, "right-handed" is to be understood in particular to mean that the spiral-shaped flow-conducting element winds in a clockwise direction. The term "left-handed" can also be replaced by the terms "turning counterclockwise" or "curving to the left". Accordingly, the term "right-handed" can also be replaced by the terms "turning clockwise" or "curving to the right". A respective curvature direction of the spiral-shaped flow-conducting element is therefore to be equated with the direction of movement of the spiral-shaped flow-conducting element. This means that, in the event that the spiral-shaped flow-conducting element is left-handed, it in particular has a curvature direction that curves to the left. Accordingly, in the event that the spiral-shaped flow-conducting element is right-handed, it in particular has a curvature direction that curves to the right. The aforementioned exit angle of the conical spray jet from the nozzle can be influenced by changing the distance between a wall of the spiral-shaped flow-conducting element and a center point of the respective nozzle. A distance from a center point of a logarithmic spiral changes by the same factor on each revolution. If this factor is chosen to be very small, the exit angle can be made smaller as a result. Conversely, the exit angle can be made larger if the factor is increased. When using an Archimedean spiral, the distance can be set in a variable manner if a spiral radius is made larger or smaller accordingly.

In accordance with a further embodiment, the spray facility has a rotatably mounted circular element, to which the washing liquor and/or the fresh water can be applied during operation of the spray facility, in order to cause the circular element to rotate.

That the washing liquor and/or the fresh water "can be applied" to the circular element is to be understood in the present context to mean that, during operation of the spray facility, the washing liquor and/or the fresh water flows over the circular element, whereby the circular element is made to rotate about an axis of rotation. As a result of the washing liquor and/or the fresh water exiting the nozzle as a rotating conical spray jet, it is possible to increase a driving torque acting on the circular element, as the conical spray jet impinges upon not only a hub, but also moving blades of the circular element.

In accordance with a further embodiment, the circular element has moving blades, wherein a curvature direction of the moving blades corresponds with a curvature direction of the spiral-shaped flow element.

In the event that the moving blades curve to the left, the spiral-shaped flow-conducting element likewise comprises a curvature direction curving to the left, or the spiral-shaped flow-conducting element is left-handed. In the event that the moving blades curve to the right, the spiral-shaped flow-conducting element likewise has a curvature direction oriented to the right, or the spiral-shaped flow-conducting element is right-handed. With the aid of the identical curvature directions, the driving torque acting on the circular element can be increased once more. This improves the spray pattern once again.

In accordance with a further embodiment, the circular element is accommodated in a cage and is rotatably mounted therein.

The cage preferably has a plurality of interconnected struts, which are connected to a housing of the spray facility, for example snap-fitted or latched. The strips meet at a connecting section, which has a bore hole, in which the hub of the circular element is rotatably mounted.

In accordance with a further embodiment, the household dishwasher further comprises an intensive zone, which has a plurality of spray facilities.

Preferably, a plurality of such intensive zones are provided. The intensive zones can be fastened to the receptacles for items to be washed of the household dishwasher, for example. For instance, each intensive zone has three spray facilities of this kind. However, the number of spray facilities is freely selectable.

In accordance with a further embodiment, the intensive zone has a valve, in order to bring the intensive zone from an active state into an inactive state and vice versa.

Preferably, the valve is a valve that is to be actuated manually. For example, the valve can have a valve body that can be linearly displaced to change the spray facility from the active state into the inactive state, and vice versa.

In accordance with a further embodiment, the intensive zone has a housing, on or in which the spiral-shaped flow-conducting elements are formed.

Preferably, the housing is a plastic part. The housing can have a bottom and a lid, for example, which are interconnected in a fixed manner. Preferably, the spiral-shaped flow-conducting elements of the spray facilities are formed on the lid.

In accordance with a further embodiment, the household dishwasher further comprises a spray arm, which is rotatably mounted in the dishwasher cavity and has a plurality of spray facilities.

In particular, a plurality of spray arms can also be provided. The spray arms are provided on the receptacles for items to be washed, on the ceiling of the dishwasher cavity or on the bottom of the dishwasher cavity, for example.

In accordance with a further embodiment, the spiral-shaped flow-conducting elements of adjacent spray facilities have curvature directions that differ from one another.

Preferably, the spray facilities are arranged such that a right-handed spiral-shaped flow-conducting element is arranged between two left-handed spiral-shaped flow-conducting elements, and vice versa. This makes it possible to improve the wetting effect further still. The spiral-shaped flow-conducting elements can also have identical curvature directions.

Further possible implementations of the household dishwasher also comprise combinations—not explicitly cited—of features or embodiments described above or below in respect of the exemplary embodiments. Here the person skilled in the art will also add individual aspects as improvements or enhancements to the respective basic form of the household dishwasher.

BRIEF DESCRIPTION OF THE DRAWINGS

Further advantageous embodiments and aspects of the household dishwasher form the subject matter of the subclaims and the exemplary embodiments of the household dishwasher described below. The household dishwasher is also described in greater detail on the basis of preferred embodiments with reference to the attached figures.

DETAILED DESCRIPTION OF EXEMPLARY EMBODIMENTS OF THE PRESENT INVENTION

Figure 1:
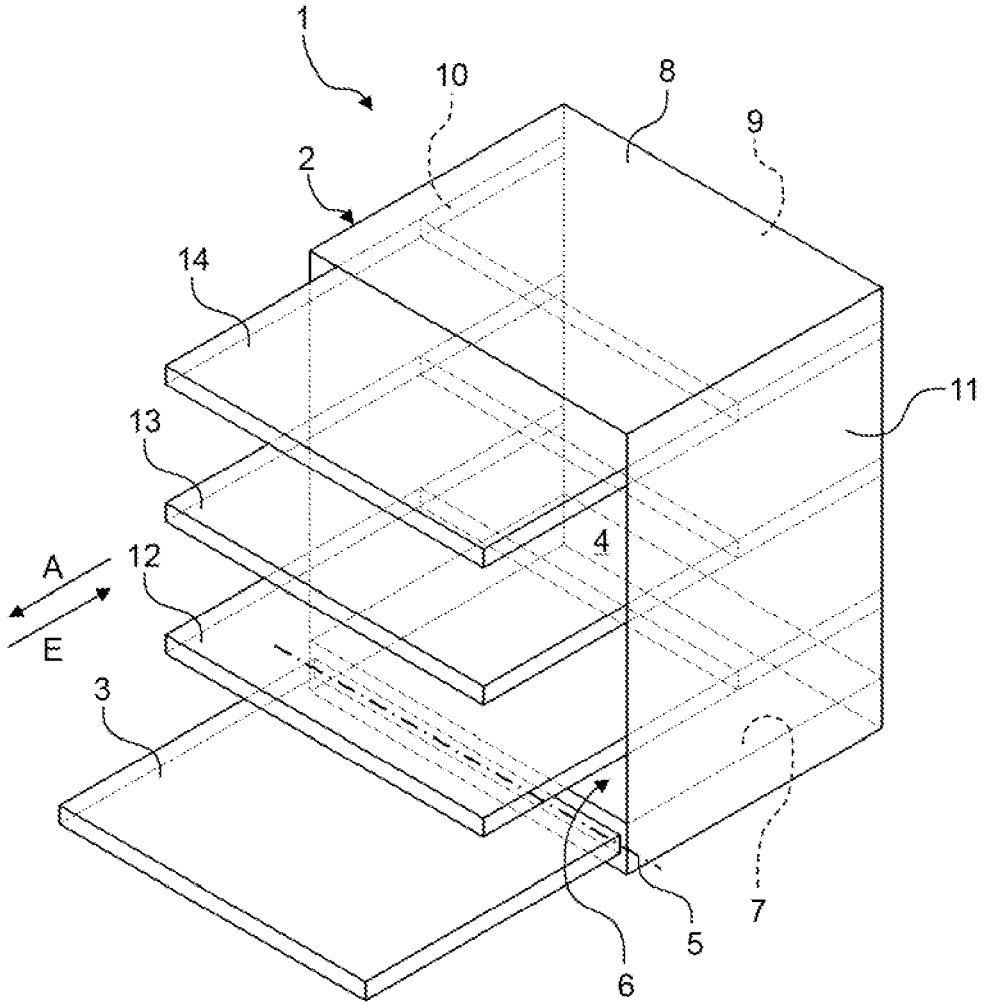
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed by a door 3, in particular in a watertight manner. To this end, a sealing facility can be provided between the door 3 and the dishwasher cavity 2. The dishwasher cavity 2 is preferably cuboid in shape. The dishwasher cavity 2 can be arranged in a housing of the household dishwasher 1. The dishwasher cavity 2 and the door can form a dishwasher interior 4 for washing items to be washed.

The door 3 is shown in its opened position in FIG. 1. The door 3 can be closed or opened by pivoting about a pivot axis 5 provided at a lower end of the door 3. With the aid of the door 3, a loading opening 6 of the dishwasher cavity 2 can be closed or opened. The dishwasher cavity 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 can be manufactured from a stainless steel sheet for example. Alternatively, the bottom 7 can be manufactured from a plastic material, for example.

Furthermore, the household dishwasher 1 has at least one receptacle for items to be washed 12 to 14. A number of, for instance three, receptacles for items to be washed 12 to 14 can preferably be provided, wherein the receptacle for items to be washed 12 can be a lower receptacle for items to be washed or a bottom basket, the receptacle for items to be washed 13 can be an upper receptacle for items to be washed or an upper basket and the receptacle for items to be washed 14 can be a cutlery drawer. As additionally shown in FIG. 1, the receptacles for items to be washed 12 to 14 are arranged one above the other in the dishwasher cavity 2. Each receptacle for items to be washed 12 to 14 is optionally able to be shifted into or out of the dishwasher cavity 2. In particular, each receptacle for items to be washed 12 to 14 is able to be inserted or pushed into the dishwasher cavity 2 in an insertion direction E and extracted or pulled out from the dishwasher cavity 2 in an extraction direction A opposite to the insertion direction E.

Figure 2:
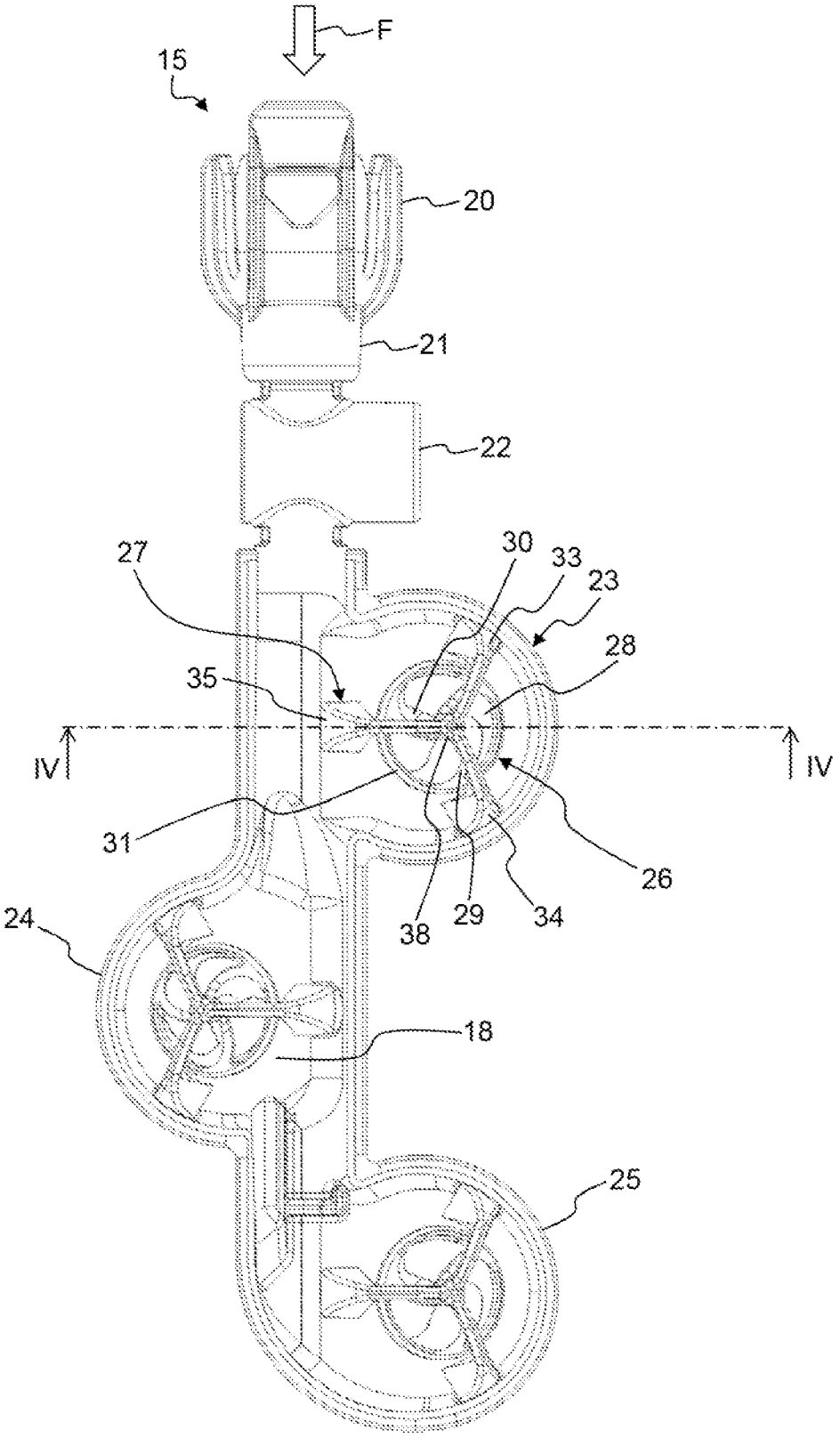
FIG. 2 shows a schematic top view of an embodiment of an intensive zone for the household dishwasher in accordance with FIG. 1.
Figure 3:
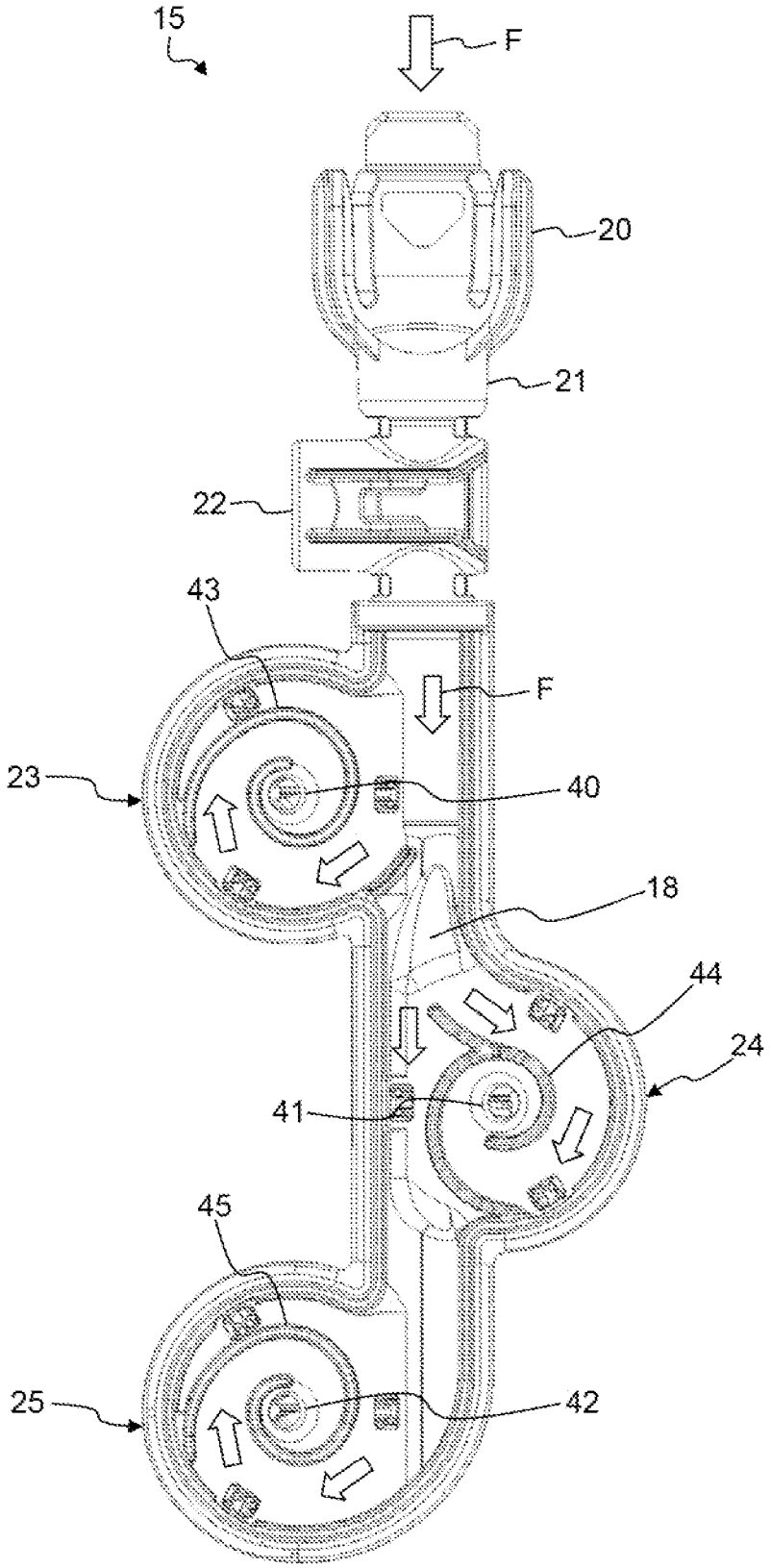
FIG. 3 shows a schematic bottom view of the intensive zone in accordance with FIG. 2.
Figure 4:
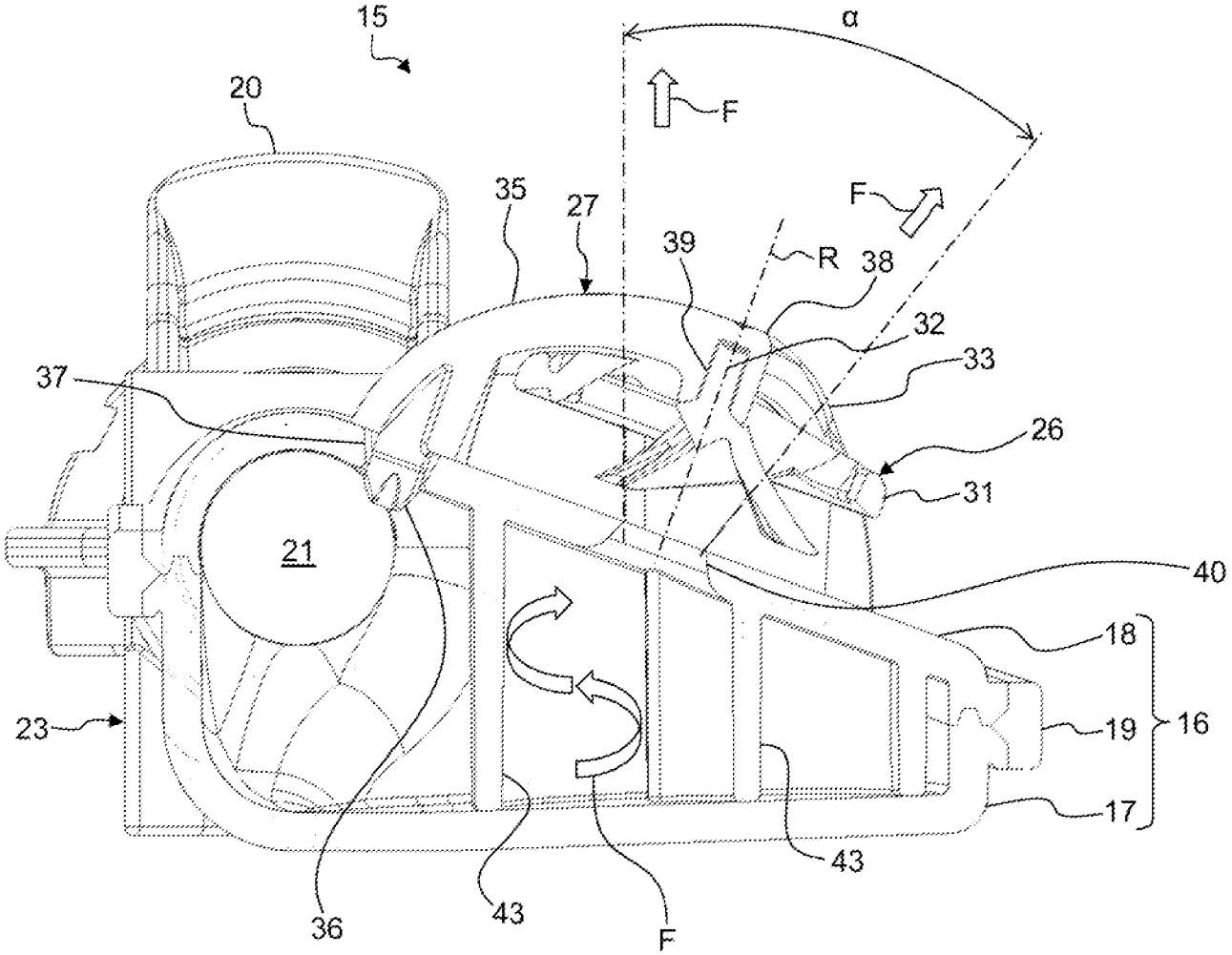
FIG. 4 shows a schematic sectional view of the intensive zone in accordance with the section line IV-IV in FIG. 2.

FIG. 2 shows a schematic top view of an intensive zone 15. FIG. 3 shows a schematic bottom view of the intensive zone 15 and FIG. 4 shows a schematic sectional view of the intensive zone in accordance with the section line Iv-Iv in FIG. 2. Reference is made below simultaneously to FIGS. 2 to 4.

The intensive zone 15 is arranged within the dishwasher cavity 2. In particular, a plurality of such intensive zones 15 can be provided within the dishwasher cavity 2. However, reference is made below to just one intensive zone 15. The intensive zone 15 can be connected to one of the receptacles for items to be washed 12 to 14 in a releasable or non-releasable manner, for example. Furthermore, the intensive zone 15 can also be provided on the bottom 7, the ceiling 8, the rear wall 9 or on one of the side walls 10, 11. In this context, the intensive zone 15 can be fastened to the dishwasher cavity 2 or the respective receptacle for items to be washed 12 to 14 in such a way that it can be separated again from the dishwasher cavity 2 or the receptacle for items to be washed 12 to 14. For example, the intensive zone 15 can be clipped onto the respective receptacle for items to be washed 12 to 14 or latched thereto. The household dishwasher 1 can therefore be equipped with an intensive zone 15 or with a plurality of intensive zones 15 in a modular manner.

The intensive zone 15 comprises a housing 16 with a bottom 17, which is not shown in FIG. 3, however, and a lid 18. The bottom 17 and the lid 18 are interconnected with the aid of a connecting element 19. The housing 16 comprises the connecting element 19. For example, the bottom 17, the lid 18 and the connecting element 19 are adhesively bonded or welded to one another.

Furthermore, the housing 16 comprises a coupling element 20, with the aid of which the intensive zone 15 is releasably connected to a supply pipe (not shown) of the household dishwasher 1. For example, in the event that the intensive zone 15 is provided on one of the receptacles for items to be washed 12 to 14, when the receptacle for items to be washed 12 to 14 is inserted into the dishwasher cavity 2 in the insertion direction E, the coupling element 20 is connected to the supply pipe, and when the receptacle for items to be washed 12 to 14 is extracted in the extraction direction A, the coupling element 20 is separated again from the supply pipe. With the aid of the coupling element 20, washing liquor and/or fresh water F can therefore be supplied to the intensive zone 15 during operation of the household dishwasher 1.

Furthermore, the housing 16 comprises a supply line 21, which is provided downstream of the coupling element 20. The intensive zone 15 can further comprise a valve 22, which is provided on the housing 16 and for example can be switched manually in order to activate and deactivate the intensive zone 15. The coupling element 20, the supply line 21 and the valve 22 can be connected to the lid 18 of the housing 16 in one piece, in particular as one piece of material. The valve 22 comprises a valve body (not shown), which can be moved in order to activate and deactivate the intensive zone 15.

The intensive zone 15 comprises a plurality of spray facilities 23 to 25. The number of spray facilities 23 to 25 is freely selectable. For example, three spray facilities 23 to 25 of this kind can be provided. The spray facilities 23 to 25 can also be provided individually on the inside of the dishwasher cavity 2 or the receptacles for items to be washed 12 to 14. This means that the spray facilities 23 to 25 are not necessarily assigned to an intensive zone 15 as mentioned above.

Each spray facility 23 to 25 comprises a circular element 26, which is rotatably mounted about an axis of rotation R (FIG. 4) in a cage 27. The circular element 26 comprises a plurality of moving blades 28 to 30, for example three. The moving blades 28 to 30 are interconnected with the aid of a connecting ring 31 that runs around the circular element 26. Furthermore, the moving blades 28 to 30 are interconnected with the aid of a hub 32 that is rotatably mounted on the cage 27.

The cage 27 comprises a plurality of struts 33 to 35, which are connected to the lid 18. For example, the struts 33 to 35 are snap-fitted or latched into the lid 18. Alternatively, the struts 33 to 35 can also be embodied in one piece with the lid 18, in particular as one piece of material. The number of struts 33 to 35 is freely selectable. For example, three struts 33 to 35 of this kind are provided, which are positioned at an angle of 120° in relation to one another. As shown in FIG. 4, a latching element 36 can be provided at the end of the struts 33 to 35 in each case, which is snap-fitted or latched into an opening 37 of the lid 18. The struts 33 to 35 meet at a mounting section 38, which has a bore hole 39, in which the hub 32 of the circular element 26 is rotatably mounted.

The spray facilities 23 to 25 preferably have an identical construction. As additionally shown in FIG. 3, the spray facilities 23 to 25 each have a nozzle 40 to 42. This means that each spray facility 23 to 25 is assigned a nozzle 40 to 42. The nozzles 40 to 42 are suitable for spraying the washing liquor and/or the fresh water F in the dishwasher cavity 2.

Each spray facility 23 to 25 is furthermore assigned a spiral-shaped flow-conducting element 43 to 45 shown in FIG. 3. With the aid of the spiral-shaped flow-conducting elements 43 to 45, the washing liquor and/or the fresh water F is fed to the respective nozzle 40 to 42. The spiral-shaped flow-conducting elements 43 to 45 can be right-handed or left-handed. In this context, "right-handed" means curving in a clockwise direction. "Left-handed" means curving in a counterclockwise direction. As shown in FIG. 3, the spiral-shaped flow elements 43 to 45 are right-handed. This means that the washing liquor and/or the fresh water F is supplied to the respective nozzle 40 to 42 such that it is rotating clockwise.

Figure 5:
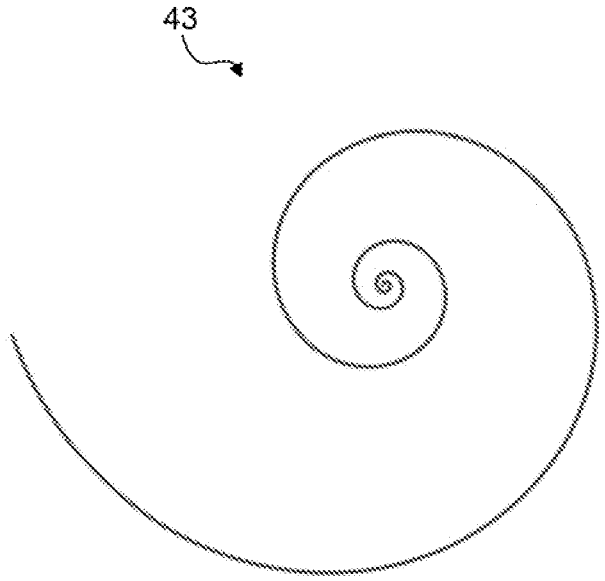
FIG. 5 shows a schematic view of an embodiment of a spiral-shaped flow-conducting element for the intensive zone in accordance with FIG. 2.

As shown in FIG. 5, the spiral-shaped flow-conducting elements 43 to 45 can be embodied as a logarithmic spiral in each case. In FIG. 5, the spiral-shaped flow-conducting element 43 is embodied as a left-handed logarithmic spiral. A logarithmic spiral is a spiral, in which a distance a (FIG. 7) from its center point changes by the same factor on each revolution about the center point. A radius of the logarithmic spiral therefore grows proportionately to an arc or spiral length of the spiral. As previously mentioned, the spiral-shaped flow-conducting element 43 can also be right-handed.

Figure 6:
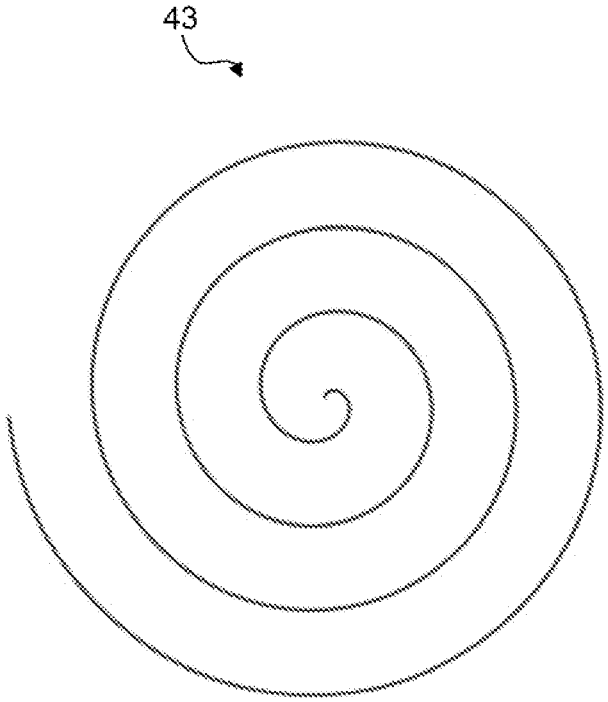
FIG. 6 shows a schematic view of a further embodiment of a spiral-shaped flow-conducting element for the intensive zone in accordance with FIG. 2.

As shown in FIG. 6, however, the spiral-shaped flow-conducting elements 43 to 45 can also be embodied as an Archimedean spiral in each case. In FIG. 6, the spiral-shaped flow-conducting element 43 is embodied as a left-handed Archimedean spiral. An Archimedean spiral occurs when a radius of the spiral grows proportionately to its angle of rotation during a rotary movement.

The functionality of the intensive zone 15 or the spray facility 23 to 25 is explained in the following. As a result of each spray facility 23 to 25 being assigned a spiral-shaped flow-conducting element 43 to 45, the washing liquor and/or the fresh water F exits the nozzles 40 to 42 in the form of a rotating conical spray jet 46 (FIG. 4). The conical spray jet 46 impinges upon the circular element 26 and causes this to rotate about the axis of rotation R. In this context, an exit rotation direction of the washing liquor and/or the fresh water F from the respective nozzle 40 to 42 is chosen depending on the direction of the spiral-shaped flow-conducting elements 43 to 45, preferably the same as a direction of rotation of the circular element 26. This makes it possible to apply a higher driving torque to the circular element 26. Furthermore, by generating the conical spray jet 46, the moving blades 28 to 30 and not just the hub 32 are flowed over directly, which increases the driving torque further still. In this context, the circular element 26 is more tolerant to dirt and less susceptible to blockages.

Figure 7:
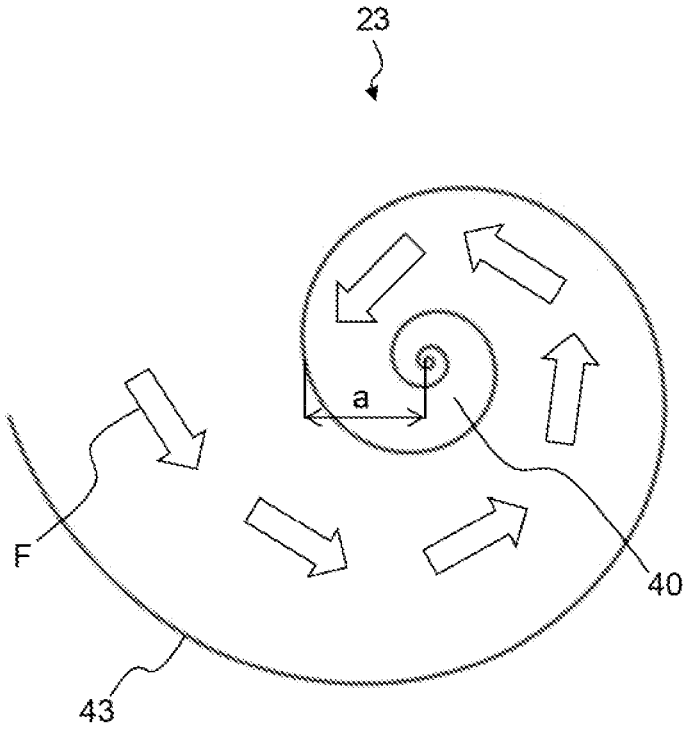
FIG. 7 shows a schematic view of a further embodiment of a spiral-shaped flow-conducting element for the intensive zone in accordance with FIG. 2.

An exit angle α (FIG. 4) of the conical spray jet 46, established during operation of the intensive zone 15 or the spray facilities 23 to 25, can be influenced, as shown in FIG. 7 on the basis of the left-handed logarithmic spiral, by changing the previously mentioned distance a between the spiral-shaped flow-conducting element 43 and a center point of the respective nozzle 40 to 42 or of the respective spiral-shaped flow-conducting element 43 to 45. The distance a from the center point of the nozzle 40 or of the spiral-shaped flow-conducting element 43 changes by the same factor on each revolution of the spiral-shaped flow-conducting element 43 about the center point. If this factor is chosen to be very small, the exit angle α can be made smaller as a result. Conversely, the exit angle α can be made larger if the previously cited factor is increased.

When using an Archimedean spiral for the spiral-shaped flow-conducting element 43, however, the distance a can be set in a variable manner if a radius of the spiral-shaped flow-conducting element 43 is made larger or smaller accordingly. This means that the further away from the nozzle 40 a wall of the spiral-shaped flow-conducting element 43 is arranged, the larger the exit angle α becomes.

Figure 8:
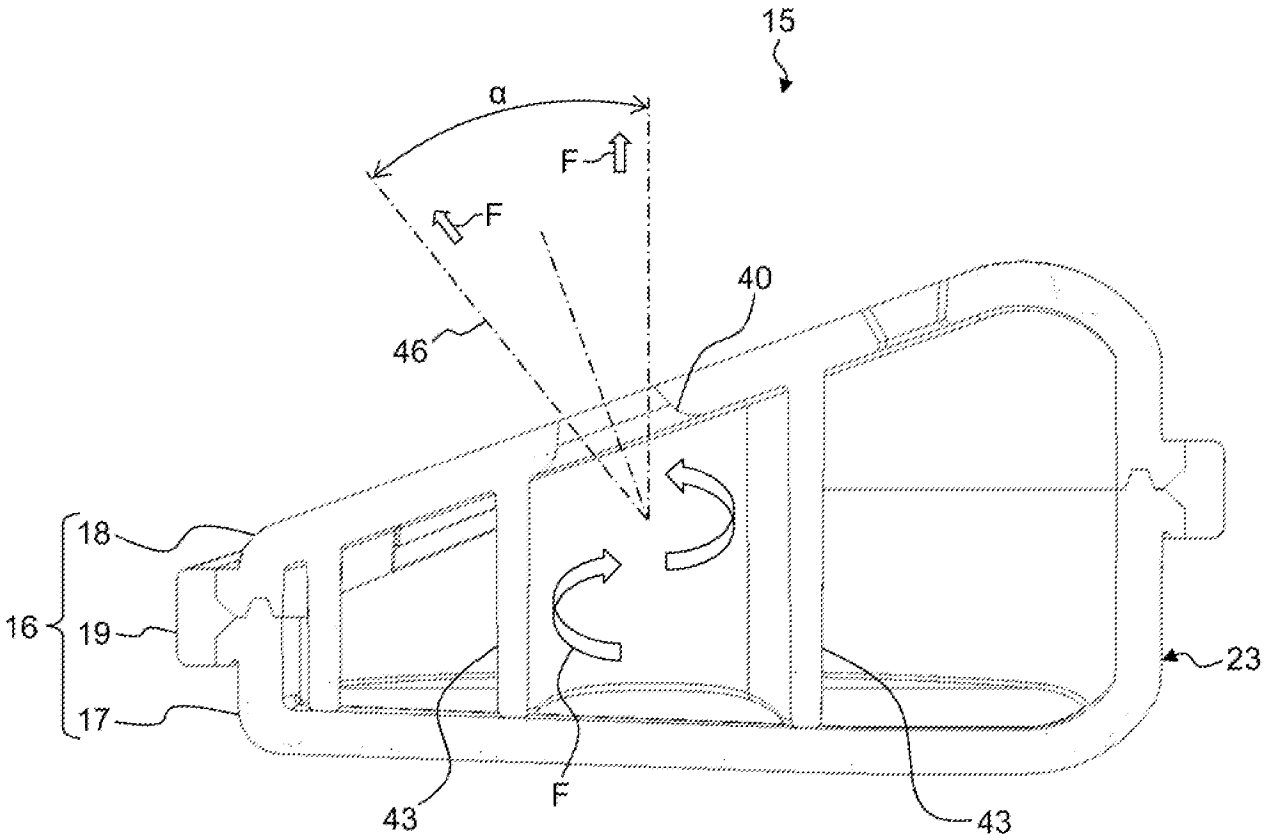
FIG. 8 shows a schematic sectional view of a further embodiment of an intensive zone for the household dishwasher in accordance with FIG. 1.

FIG. 8 shows a schematic sectional view of a further embodiment of an intensive zone 15. In this embodiment of the intensive zone 15, the spray facilities 23 to 25 comprise neither a circular element 26 nor a cage 27. This means that the rotating conical spray jet 46 exits the nozzle 40 without impinging upon the circular element 26. Otherwise, the functionality remains identical.

Figure 9:
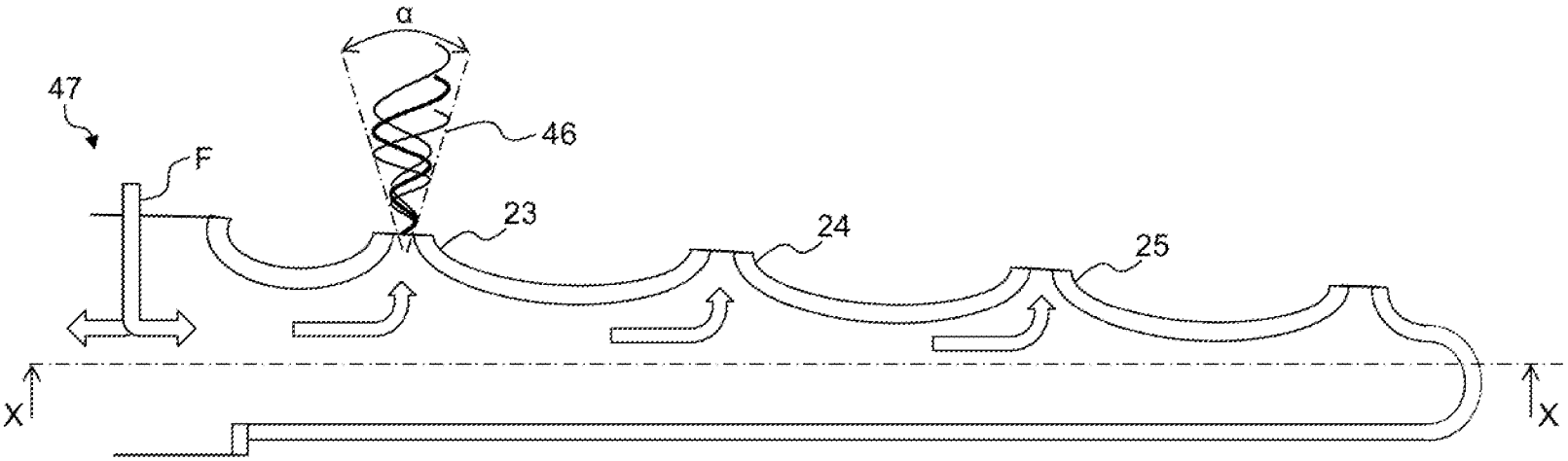
FIG. 9 shows a schematic sectional view of an embodiment of a spray arm for the household dishwasher in accordance with FIG. 1.
Figure 10:
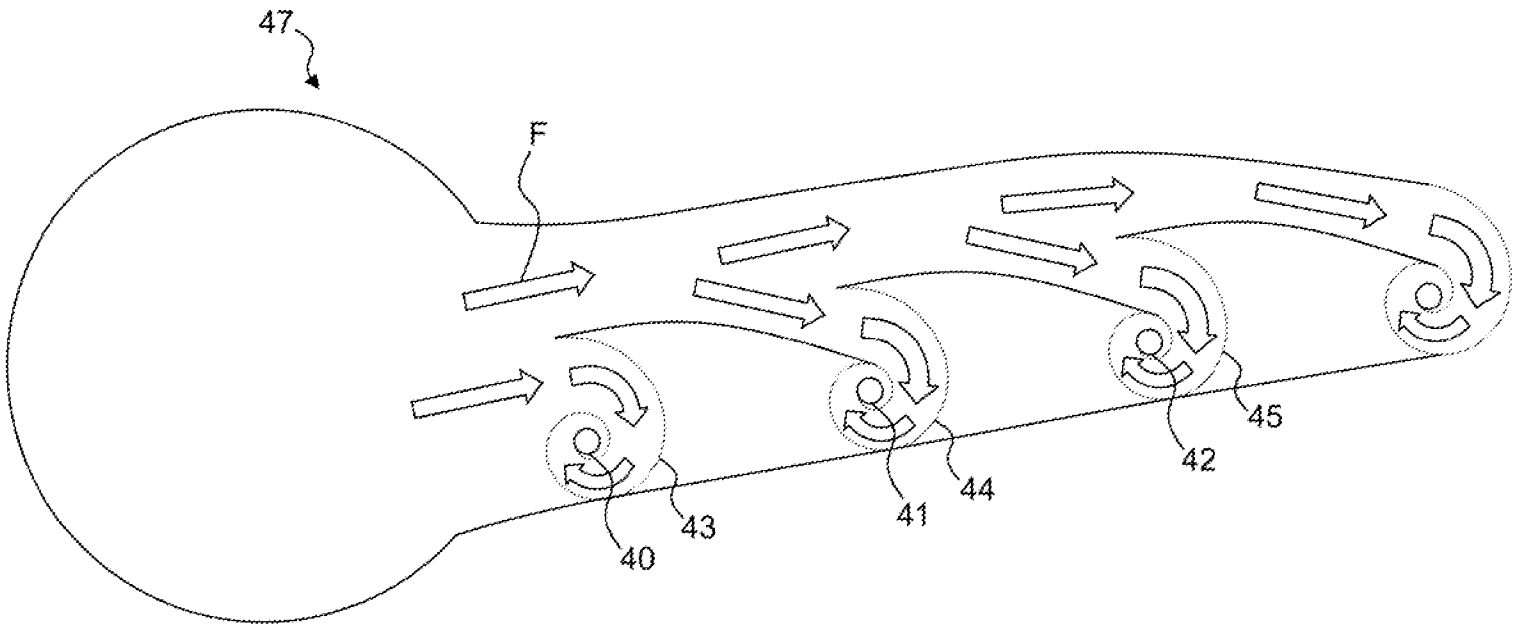
FIG. 10 shows a further schematic sectional view of the spray arm in accordance with the section line X-X in FIG. 9.
Figure 11:
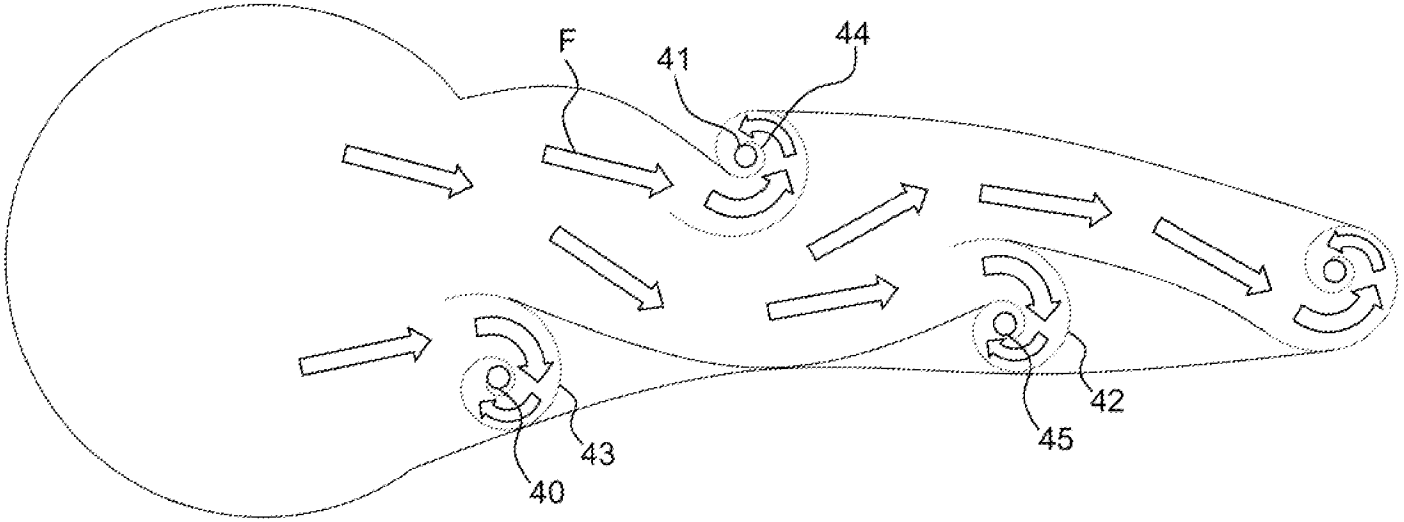
FIG. 11 shows a schematic sectional view of a further embodiment of a spray arm for the household dishwasher in accordance with FIG. 1.

FIG. 9 shows a schematic sectional view of an embodiment of a spray arm 47 for the household dishwasher 1. FIG. 10 shows a further schematic sectional view of the spray arm 47 in accordance with the section line X-X in FIG. 9. FIG. 11 shows a schematic sectional view of a further embodiment of a spray arm 47. Reference is made below simultaneously to FIGS. 9 to 11.

The spray arm 47 is rotatably mounted in the dishwasher cavity 2. For example, the spray arm 47 can be fastened to the underside of one of the receptacles for items to be washed 12 to 14, of the ceiling 8 or of the bottom 7 of the dishwasher cavity 2. Preferably, a plurality of such spray arms 47 are provided. The spray arm 47 comprises a large number of spray facilities 23 to 25 as explained above, of which only three are provided with a reference character in FIGS. 9 to 11, however.

As shown in FIG. 10, each spray facility 23 to 25, as previously mentioned, is assigned a nozzle 40 to 42 and a spiral-shaped flow-conducting element 43 to 45. In the embodiment of the spray arm 47 in accordance with FIGS. 9 and 10, all spiral-shaped flow-conducting elements are right-handed. In the embodiment of the spray arm 47 in accordance with FIG. 11, the spiral-shaped flow-conducting elements 43 to 45 are alternately right-handed and left-handed. In the embodiment of the spray arm 47 in accordance with FIGS. 9 and 10, an exit rotation direction of the washing liquid and/or the fresh water F is effected in a clockwise direction at all nozzles 40 to 42.

In the embodiment of the spray arm 47 in accordance with FIG. 11, however, the washing liquor and/or the fresh water F exit alternately clockwise and counterclockwise. With a corresponding arrangement of the nozzles 40 to 42 and the exit angle α of the conical spray jet 46 being designed, it is possible to achieve a continuous, direct wetting of the items to be washed compared to known concentric spray jet circular paths.

Although the present invention has been described with reference to exemplary embodiments, it can be modified in numerous different ways.

The invention claimed is:

1. A household dishwasher, comprising:

a dishwasher cavity; and a spray facility arranged within the dishwasher cavity for spraying washing liquor and/or fresh water in the dishwasher cavity, said spray facility comprising a nozzle for spraying the washing liquor and/or the fresh water and a flow-conducting element for feeding the washing liquor and/or the fresh water to the nozzle, said flow-conducting element being configured, during operation of the spray facility, to feed the washing liquor and/or the fresh water to the nozzle in such a way that the washing liquor and/or the fresh water exits the nozzle as a rotating conical spray jet based on a spiral shape of the flow-conducting element.

2. The household dishwasher of claim 1, wherein the spiral shape of the flow-conducting element is embodied in the form of an Archimedean spiral or in the form of a logarithmic spiral.

3. The household dishwasher of claim 1, wherein the spray facility includes a rotatably mounted circular element, which is acted upon by the washing liquor and/or the fresh water during operation of the spray facility to cause the circular element to rotate.

4. The household dishwasher of claim 3, wherein the circular element includes moving blades configured to exhibit a curvature direction which corresponds with a curvature direction of the spiral shape of the flow-conducting element.

5. The household dishwasher of claim 3, further comprising a cage configured to accommodate the circular element, said circular element being rotatably mounted in the cage.

6. The household dishwasher of claim 1, further comprising an intensive zone configured to include a plurality of said spray facility.

7. The household dishwasher of claim 6, wherein the intensive zone includes a valve configured to bring the intensive zone from an active state into an inactive state and vice versa.

8. The household dishwasher of claim 6, wherein the intensive zone includes a housing, on or in which the flow-conducting element is formed.

9. The household dishwasher of claim 1, further comprising a spray arm rotatably mounted in the dishwasher cavity, and a plurality of said spray facility provided on the spray arm.

10. The household dishwasher of claim 9, wherein the spiral shape of adjacent flow-conducting elements of the spray facilities have curvature directions that differ from one another.

* * * * *